US005220748A

United States Patent [19]

Chadbourne

[11] Patent Number: 5,220,748

[45] Date of Patent: Jun. 22, 1993

[54] DOOR AND WINDOW CASING ASSEMBLY

[76] Inventor: Wingate Chadbourne, 12501 Hwy. West, P.O. Box 383, Winona, Tex. 75792

[21] Appl. No.: 907,588

[22] Filed: Jul. 2, 1992

[51] Int. Cl.[5] ..... E06B 1/04

[52] U.S. Cl. ..... 49/505; 52/217

[58] Field of Search ..... 49/505; 52/217, 212, 52/211

[56] References Cited

U.S. PATENT DOCUMENTS

| | | | |
|---|---|---|---|
| 2,742,117 | 4/1956 | Tolman | 49/505 |
| 3,248,833 | 5/1966 | Sklar | 49/505 |
| 3,545,135 | 12/1970 | Lieber | 49/505 |
| 3,571,995 | 3/1971 | Kasprzak | 52/217 |
| 3,800,488 | 4/1974 | Swanson | 49/505 |
| 3,906,671 | 9/1975 | Maldonado | 49/505 |
| 4,128,977 | 12/1978 | Schubeis | 52/217 |
| 4,878,325 | 11/1989 | Van Tuyl et al. | 49/505 |

FOREIGN PATENT DOCUMENTS

| | | | |
|---|---|---|---|
| 2301143 | 1/1973 | Fed. Rep. of Germany | 49/505 |
| 2422180 | 11/1975 | Fed. Rep. of Germany | 49/505 |
| 3900608 | 7/1990 | Fed. Rep. of Germany | 49/505 |
| 408375 | 2/1966 | Switzerland | 49/505 |

*Primary Examiner*—Peter M. Cuomo
*Assistant Examiner*—Michael Milano
*Attorney, Agent, or Firm*—Leon Gilden

[57] ABSTRACT

A generally U-shaped casing includes cooperating frameworks slidably mounted relative to one another to effect spacing of confronting channels to accommodate variations in construction to employ threaded adjuster structure to effect such spacing.

2 Claims, 4 Drawing Sheets

DOOR AND WINDOW CASING ASSEMBLY

BACKGROUND OF THE INVENTION

1. Field of the Invention

The field of invention relates to construction framework organizations, and more particularly pertains to a new and improved door and window casing assembly wherein the same is arranged to adjustably accommodate variations in thickness accepting the casing structure.

2. Description of the Prior Art

In construction of various buildings, the building will confront various wall thicknesses. To effect such accommodation, the instant invention is addressed to effect an adjustment to accommodate such different and varying thicknesses. Prior art window casing structure has heretofore not addressed this issue in a manner to effect a compact and effective cooperation of components as indicated by the instant invention, wherein such prior art is exemplified in the U.S. Pat. Nos. 4,439,965; 4,909,005; 3,774,345; and 4,443,984.

Accordingly, there remains a need for a new and improved door and window casing assembly as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of door and window casing structure now present in the prior art, the present invention provides a door and window casing assembly wherein the same is directed to adjustably accommodate varying wall thicknesses during installation. As such, the general purpose of the present invention, which will be described subsequently in greater detail, is to provide a new and improved door and window casing assembly which has all the advantages of the prior art window casing structure and none of the disadvantages.

To attain this, the present invention provides a generally U-shaped casing including cooperating frameworks slidably mounted relative to one another to effect spacing of confronting channels to accommodate variations in construction to employ threaded adjuster structure to effect such spacing.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms of phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved door and window casing assembly which has all the advantages of the prior art door and window casing structure and none of the disadvantages.

It is another object of the present invention to provide a new and improved door and window casing assembly which may be easily and efficiently manufactured and marketed.

It is a further object of the present invention to provide a new and improved door and window casing assembly which is of a durable and reliable construction.

An even further object of the present invention is to provide a new and improved door and.window casing assembly which is susceptible of a low cost of manufacture with regard to both materials and labor, and which accordingly is then susceptible of low prices of sale to the consuming public, thereby making such door and window casing assemblies economically available to the buying public.

Still yet another object of the present invention is to provide a new and improved door and window casing assembly which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
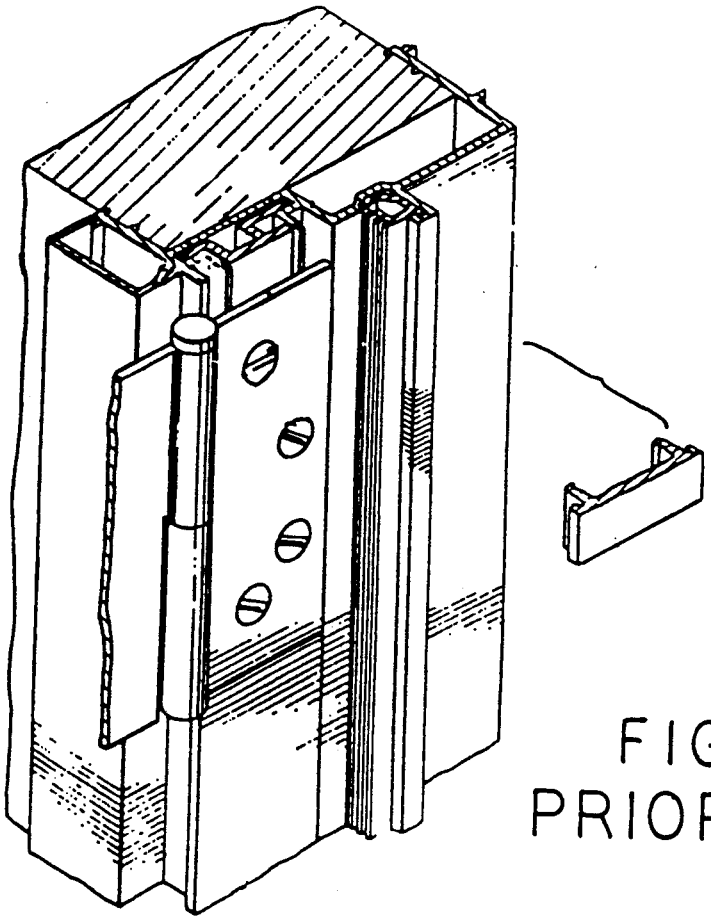
FIG 1 PRIOR ART
FIG. 1 is an isometric illustration of a prior art window casing type structure.
Figure 2:
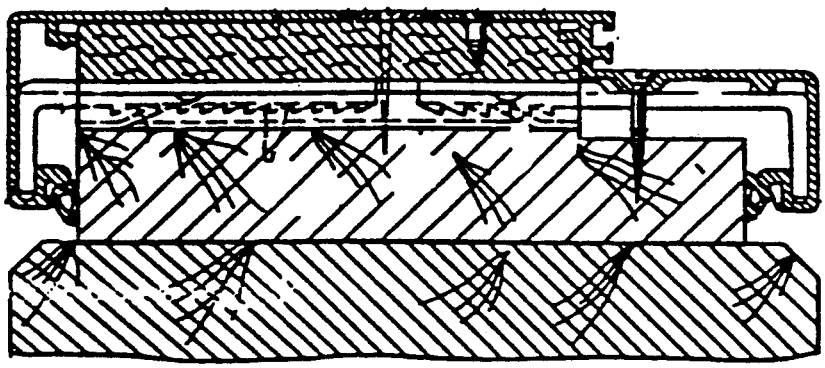
FIG 2 PRIOR ART
FIG. 2 is an orthographic cross-sectional illustration of a further example of a door casing assembly.
Figure 3:
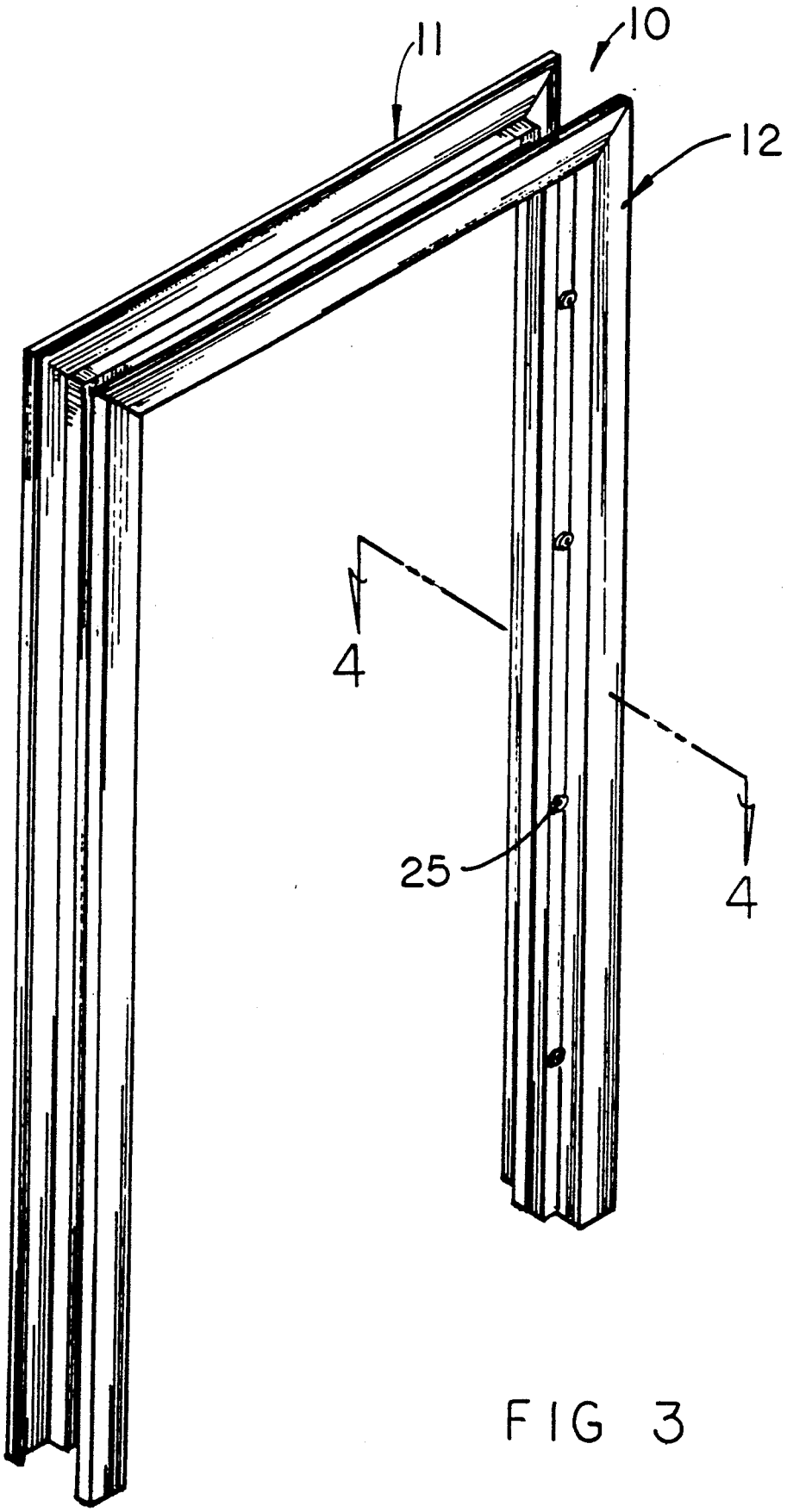
FIG. 3 is an isometric illustration of the instant invention.

With reference now to the drawings, and in particular to FIGS. 1 to 9 thereof, a new and improved door and window casing assembly embodying the principles and concepts of the present invention and generally designated by the reference numeral 10 will be described.

FIG. 1 is a prior art door casing structure, as set forth in the U.S. Pat. No. 3,774.345, of typical construction, as is the FIG. 2 indication of U.S. Pat. No. 4,439,965.

Figure 4:
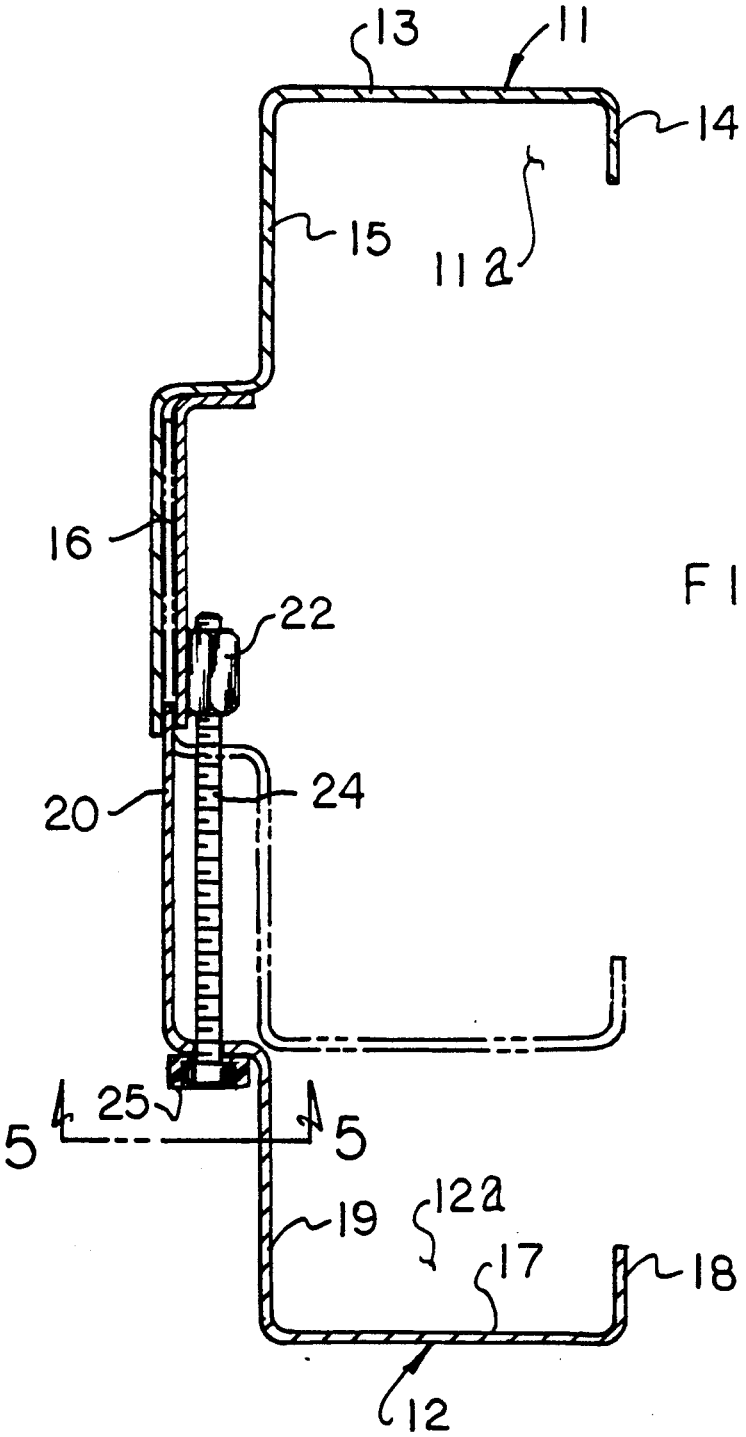
FIG. 4 is an orthographic view, taken along the lines 4—4 of FIG. 3 in the direction indicated by the arrows.
Figure 5:
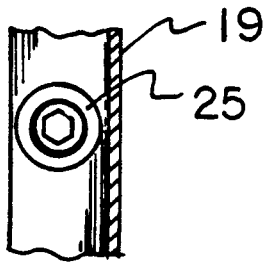
FIG. 5 is an orthographic view, taken along the lines 5—5 of FIG. 4 in the direction indicated by the arrows.

More specifically, the door and window casing assembly 10 of the instant invention essentially comprises first and second C-shaped frames 11 and 12 slidably mounted relative to one another, with a first C-shaped frame 11 including a first base plate 13 having a first base plate first flange 14 spaced from and parallel a first base plate second flange 15 that extends beyond the first base plate first flange 14 to define a receiving channel 16 parallel to the first base plate second flange 15 and offset laterally therefrom a predetermined spacing apaced laterally beyond the first base plate 13. The second base plate 17 has a second base plate first flange 18 spaced from and parallel a second base plate second flange 19 and is parallel to the second base plate first flange 18 extending therebeyond the second base plate 17, with the second base plate first flange 18 coplanar with the first base plate first flange 14 and the second base plate second flange 19 coplanar with the first base plate second flange 15. The first and second C-shaped frames 11 and 12 define respective first and second frame channels 11*a* and 12*a* respectively in confrontation relative to one another, in a manner as illustrated in FIG. 4, wherein the frame channels are of a generally U-shaped configuration extending coextensively with the first and second frames 11 and 12. A guide flange 20 is laterally offset beyond the second base plate 17 and spaced the predetermined spacing relative to the second base plate second flange 19 and slidably received within the receiving channel 16. An internally threaded tube 22 that is mounted on the channel 16 and oriented between the channel 16 and the first base plate second flange 15 threadedly receives a fastener rod 24 directed into the threaded tube from the guide flange 20. Relative rotation of each of the fastener rods 24 (see FIG. 3) relative to their respective tubes 22 effects relative reciprocation of the first C-shaped frame 11 relative to the second C-shaped frame 12, with each threaded fastener rod 24 having a head 25 oriented exteriorly of each guide flange 20 to maintain the positioning of the threaded rod relative to the guide flange 20.

Figure 6:
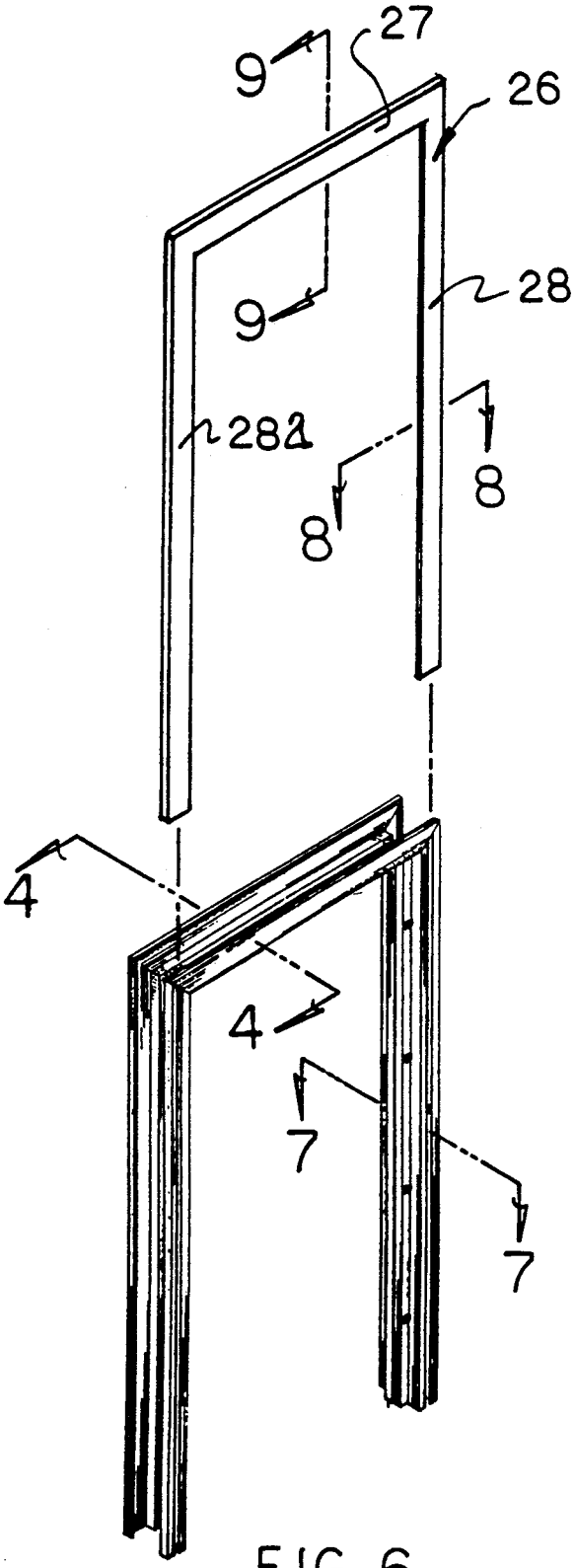
FIG. 6 is an isometric view of the invention employing a trim framing structure.
Figure 9:
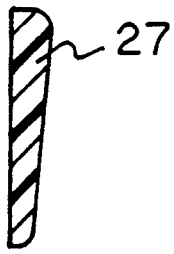
FIG. 9 is an orthographic view, taken along the lines 9—9 of FIG. 6 in the direction indicated by the arrows.
Figure 8:
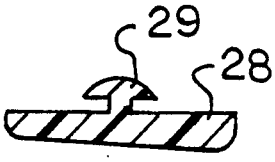
FIG. 8 is an orthographic view, taken along the lines 8—8 of FIG. 6 in the direction indicated by the arrows.
Figure 7:
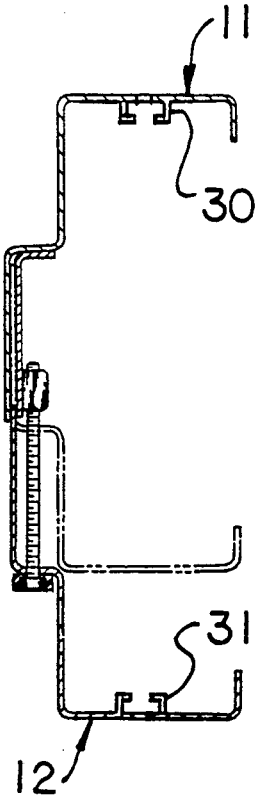
FIG. 7 is an orthographic view, taken along the lines 7—7 of FIG. 6 in the direction indicated by the arrows.

The FIGS. 6–8 illustrate the use of an optional polymeric U-shaped trim flange 26 having a trim flange top plate 27 received within an upper end of the casing assembly, with the trim flange 26 having trim flange first and second side plates 28 and 28*a* respectively extending orthogonally downwardly relative to the top plate 27. Each of the side plates includes a plurality of head projections 29, of a type as illustrated in FIG. 8, received within respective first and second frame channels 30 and 31 mounted within the first and second frame channels 11*a* and 12*a* to provide for positioning of the flange 26 relative to the casing assembly structure.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A door and window casing assembly, comprising, a first C-shaped frame slidably received within a second C-shaped frame to define a U-shaped framework, wherein the first C-shaped frame includes a first C-shaped base plate having a first base plate first flange and a first base plate second flange arranged in a parallel relationship, with the first base plate second flange extending beyond the first base plate first flange, with a receiving channel integrally mounted to the first base plate second flange laterally offset relative to the first base plate second flange a predetermined spacing, wherein the second C-shaped frame includes a second C-shaped base plate having a second base plate first flange parallel to a second base plate second flange, with the second base plate second flange including a guide flange laterally offset relative to the second base plate second flange the predetermined spacing, with the guide flange slidably received within the receiving channel and the second base plate first flange coplanar with the first base plate first flange, and the second base plate second flange coplanar with the first base plate second flange, and wherein the receiving channel includes a plurality of internally threaded tubes fixedly mounted to the receiving channel between the receiving channel and the first base plate first flange defined by a predetermined thickness less than the predetermined spacing, and the guide flange includes a plurality of threaded fastener rods, with each threaded fastener rod of said threaded fastener rods arranged for reception within one of said internally threaded tubes, with the threaded fastener rod including a fastener rod head mounted exteriorly of the guide flange, and the first C-shaped frame includes a first frame channel and the second C-shaped frame includes a second frame channel, with the first frame channel and the second frame channel arranged in a coextensive facing and parallel relationship relative to one another, and including a polymeric U-shaped trim flange, with the trim flange including a first side plate spaced from, parallel to, and coextensive with a second side plate, the first side plate received within the first frame channel and the second side plate received within the second frame channel.

2. A casing assembly as set forth in claim 1 wherein the first frame channel includes a first frame channel slot, the second frame channel includes a second frame channel slot, and the first side plate and the second side plate include respective first and second head projections, wherein the first head projections are received within the first frame channel slot and the second head projections received within the second frame channel slot.

* * * * *